US006085861A

United States Patent [19]

Jines

[11] Patent Number: 6,085,861

[45] Date of Patent: Jul. 11, 2000

[54] COLLAPSIBLE PORTABLE ACOUSTIC TOWER

[75] Inventor: Michael D. Jines, Owatonna, Minn.

[73] Assignee: Wenger Corporation, Owatonna, Minn.

[21] Appl. No.: 09/168,656

[22] Filed: Oct. 8, 1998

[51] Int. Cl.[7] ..... E04B 1/99

[52] U.S. Cl. ..... 181/30; 181/287; 181/198; 181/210; 181/284; 181/296; 52/6; 52/7; 52/64; 52/65; 52/69; 52/71; 52/144

[58] Field of Search ..... 181/30, 287, 198, 181/210, 284, 296; 52/6, 7, 64, 65, 69, 71, 144

[56] References Cited

U.S. PATENT DOCUMENTS

| | | | |
|---|---|---|---|
| Re. 34,468 | 12/1993 | Rau et al. | 296/26 |
| D. 304,083 | 10/1989 | Jenné | D25/58 |
| 425,962 | 4/1890 | Stockton | 135/1 |
| 1,521,803 | 1/1925 | Dossenbach | 20/2 |
| 2,132,238 | 10/1938 | Haisty | 135/1 |
| 2,155,876 | 4/1939 | Stout | 20/2 |
| 2,987,121 | 6/1961 | Haws | 160/188 |
| 3,007,539 | 11/1961 | Brewer et al. | 181/33 |
| 3,180,446 | 4/1965 | Wenger | 181/30 |
| 3,181,203 | 5/1965 | Wenger | 20/1.126 |
| 3,217,366 | 11/1965 | Wenger | 52/6 |
| 3,232,370 | 2/1966 | Jaffe | 181/30 |
| 3,258,884 | 7/1966 | Wenger | 52/6 |
| 3,417,518 | 12/1968 | Jaffe | 52/7 |
| 3,435,909 | 4/1969 | Wenger et al. | 181/30 |
| 3,620,564 | 11/1971 | Wenger et al. | 296/23 |
| 3,630,309 | 12/1971 | Wenger et al. | 181/30 |
| 3,866,365 | 2/1975 | Honigman | 57/70 |
| 3,908,787 | 9/1975 | Wenger et al. | 181/30 |
| 4,241,777 | 12/1980 | Wenger et al. | 160/135 |
| 4,682,670 | 7/1987 | Lerner et al. | 181/287 |
| 4,720,945 | 1/1988 | Berranger et al. | 52/7 |
| 4,750,586 | 6/1988 | Lerner et al. | 181/295 |
| 4,875,312 | 10/1989 | Schwartz | 52/144 |
| 5,078,442 | 1/1992 | Rau et al. | 296/26 |
| 5,115,608 | 5/1992 | Abraham et al. | 52/238.1 |
| 5,152,109 | 10/1992 | Boers | 52/143 |
| 5,381,873 | 1/1995 | Kniefel et al. | 182/152 |
| 5,400,551 | 3/1995 | Uhl | 52/68 |
| 5,403,979 | 4/1995 | Rogers et al. | 181/30 |
| 5,524,691 | 6/1996 | Jines | 160/135 |
| 5,525,765 | 6/1996 | Freiheit | 181/30 |
| 5,530,211 | 6/1996 | Rogers et al. | 181/30 |
| 5,651,405 | 7/1997 | Boeddeker et al. | 160/135 |

FOREIGN PATENT DOCUMENTS

| | | |
|---|---|---|
| 1-197139 | 8/1989 | Japan . |

*Primary Examiner*—Robert E. Nappi
*Assistant Examiner*—Wesley Ashton
*Attorney, Agent, or Firm*—Patterson & Keough, P.A.

[57] ABSTRACT

The acoustic tower of the present invention is a portable, acoustic tower that has both a performance position and a storage position. In the storage position, a canopy panel lies substantially parallel proximate an upper panel, both of which are hingedly secured to a cross tube assembly that is supported by a lift tube. The upper panel lies substantially parallel to a lower panel that is fixedly secured to a lower panel assembly having side supports and a center shaft which substantially contains the lift tube. To raise the acoustic tower to the performance position, the canopy panel is raised to one of a plurality of preset angles and maintained in position through use of ratchet and pawl assemblies of the cross tube assembly. With the canopy panel at the desired angle, the upper panel and canopy panel are raised vertically by telescopically elevating the lift tube within the center shaft. The lift tube is elevated by virtue of a winch assembly that is connected to the lift tube by a length of webbing. The acoustic panels and their supporting structures are all supported by a base having swivel casters.

38 Claims, 16 Drawing Sheets

70
72
74
77
78
79
90
95
98
100
102
104
106
108
112
114
116
120
122
124
126
134
140
142
144
150
154
160
162
164
166
168
172
174
176
180
192

326
UP
200
202
30
DOWN
120
160
188
121
74
106
198
196
62
20
14
52
58
300
54
52

10
52
234
74
58
52
54
300
296
18
302
304
298
60
12
48
40
42
46
9.5 IN.

COLLAPSIBLE PORTABLE ACOUSTIC TOWER

FIELD OF THE INVENTION

This invention relates to portable, multi-panel, acoustic towers and more particularly to the manner of raising and lowering the panels of the acoustic tower.

BACKGROUND OF THE INVENTION

Portable acoustic towers are generally used for choral and/or instrumental groups who perform in surroundings that, without the use of the acoustic tower or a group of acoustic towers, would not reflect the musical sound back to the performers to aid in coordination of the individual contributions to the performance. Such non-acoustical settings include auditoriums, gymnasiums and outdoor areas. Because these settings are non-traditional performance settings and, as such, are often used for non-performance activities, it is desirable that the acoustic tower not only be portable but also be easily stored in a minimal amount of space and provide the user with quick and easy set-up and take-down.

One of the first portable acoustic towers was developed by the Wenger Corporation and was patented in U.S. Pat. No. 3,180,446. This portable sound shell is disclosed as having two vertical members, or supports, to which is secured a vertical, first acoustic panel. A second acoustic panel is hingedly secured to the first panel and is provided with supports that allow the second panel to remain tilted relative the vertical panel and provide a canopy. Each of the vertical members is provided with a pair of folding feet which, when outstretched, provide stability for the sound shell. To transport the sound shell, the second panel is positioned in substantial vertical alignment with the first panel and the feet are folded inward. The whole sound shell may then be lifted and carried to a storage location. While this sound shell is of a straight-forward and useful design, the structure is not weighted and/or balanced to provide significant panel height and the necessity to actually lift and carry the sound shell, which can be quite heavy, creates a hardship on the user.

A later development in acoustic towers or shells, also by the Wenger Corporation, provides a mobile base and a tower with even more acoustic panels capable of reaching greater heights, see U.S. Pat. No. 3,630,309. This portable shell includes a frame structure with a rearwardly extending base incorporating a counterweight and four casters. Fixedly secured to the frame structure is a lower panel. A kicker panel is hingedly secured to the bottom of the lower panel; the kicker panel is rotated up and clipped in position for storage, and is unclipped and rotated downward for performance. An upper panel that has its own frame structure is hingedly secured to the frame structure of the lower panel. A canopy panel is hingedly secured, as by piano hinge, to the top edge of the upper panel. In a storage position, the canopy panel is folded close to the upper panel which rests substantially behind the lower panel. To reach performance position, the upper panel is raised and held in position with locking pins inserted into brackets such that the upper panel lies in substantial vertical alignment with the lower panel. The canopy panel is raised and secured at an angle, relative to the upper panel, by pulling downward on a pair of hinged rods that are connected to each side of the canopy panel and then securing a turnbuckle located on the ends of the rods to the frame structure.

The raising and lowering of all the panels in the portable acoustic shell described above, requires the physical maneuvering of the user, and perhaps is more efficiently handled with the physical maneuvering of two users due to the left and right side securement features required. For example, the upper panel and canopy panel must both be phsically lifted to a position the upper panel in substantial vertical alignment with the lower panel. While the upper panel is being held in an upright position, the user must hysically insert a locking pin in the frame structure to the left side of the acoustic shell. Once the upper panel is secured in position, one or two users must physically pull down on the rods connected to the canopy panel to raise it to a desired location. The user, or users, must then physically engage the turnbuckle to the frame structure on the right side of the acoustic shell and engage the turnbuckly to the foam structure on the left side of the acoustic shell to hold the position of the canopy panel. The canopy panel is provided with no means to measure the angle to which it is raised, rather the user must simply, by sight, judge the appropriate angle. Having no means to accurately and repeatably set the angle of the canopy panel requires numerous readjustments when attempting to arrange a number of the acoustic shells in a performance group.

U.S. Pat. No. 5,403,979, owned by Rogers et al., provides for a variation on the portable acoustic shell from that described above. This acoustic shell does not provide a canopy panel but rather comprises two substantially vertical panels. The lower panel is fixedly secured to a frame structure that stands atop a wheeled base. The upper panel lies in front of the lower panel at all times and includes a support structure that is telescopically secured to the frame structure of the lower panel. This support structure is provided with weighted handles that the user may press down upon or lift up upon to raise and lower, respectively, the upper panel relative the fixed lower panel. The weighted handles are weighted to substantially, exactly counterbalance the weight of the upper panel. In theory, the upper panel may be raised or lowered to any position and the exact balance of the counterweighted handles will maintain the upper panel in that position.

The acoustic shell described immediately above does not, as indicated, provide for a canopy panel and the enhanced sound acoustics it can provide. Further, while the upper panel is relatively easily raised and lowered, it always maintains its position, at least in part, in front of the lower panel; there is never vertical alignment of the panels and thus, never a full smooth panel for improved acoustics. Additionally, there is no manner in which to secure the position of the upper panel relative the lower panel. In an outdoor setting or even that of a gymnasium or auditorium there is provided no means to prevent the casual passer-by from lifting up or down on the handles and altering the position of the upper panel. Moreover, the stability and positioning of the upper panel relies completely on the substantially, exact balance of counterweights to the weight of the upper panel. Any alteration in the make-up of the panel, e.g. the panel absorbing water or the panel being otherwise damaged/modified, or in the make-up of the counterweight, e.g. damage to the counterweight, may alter this exact balance and prevent the ability of upper panel to maintain its position. Panel positions that are easily altered and/or difficult to maintain present a problem when attempting to group a number of acoustic shells. That is, not only do the unaligned panels present a sloppy and unprofessional appearance, but, the overall acoustic performance of the acoustic tower group may be significantly altered.

In view of the above, what is needed is a portable, multi-panel, acoustic tower whose panels are easily, and repeatably, raisable to a desired position by a single user. And, whose acoustic panels may be substantially secured in their position and protected from tampering. Further, with respect to the canopy panel, there is a need for a canopy panel that is easily and repeatably raisable to one of a number of predetermined angles, such that when a grouping of acoustic towers is presented a uniform and professional appearance is provided and acoustic performance is maximized. Additionally, as the portable, multi-panel, acoustic tower should provide for easy raising of its panels by a single user, it should also provide for easy lowering of its panels by a single user.

SUMMARY OF THE INVENTION

The problems described above are in large measure solved by a portable acoustic tower of the present invention. The portable acoustic tower is generally comprised of four acoustic panels; a lower panel, an upper panel, a canopy panel and a filler panel. All of the acoustic panels are supported from below by a base assembly incorporating counterweights and swivel casters which allow for easy transportation of the acoustic tower. The lower panel is secured to and supported by a lower panel assembly which generally includes side supports and a center shaft.

The upper panel of the acoustic tower is supported by a lift tube assembly that includes a lift tube and a cross tube assembly. Both the upper panel and the canopy panel are hingedly secured to the cross tube assembly which incorporates a ratchet assembly and pawl assembly. The ratchet and pawl assemblies, along with a connector rod hingedly secured to the canopy panel, enable a single user to raise the canopy panel to one of a plurality of preset angles. Once the canopy panel is raised, a winch assembly is used to raise the lift tube and, thereby, the upper panel and the canopy panel, to a performance position. The winch assembly is connected to the lift tube via a length of webbing that is threaded through the center shaft of the lower panel assembly to the lower end of the lift tube. The winch assembly is provided with a handle that may be removed for security purposes once the acoustic tower has been established in the performance position. The filler panel is hingedly secured to the lower edge of the lower panel and is rotated downward, into substantial vertical alignment with the lower panel, for its performance position. A number of acoustic towers may be arranged in a grouping to form an acoustic performance shell.

The acoustic tower of the present invention is easily disassembled into its storage position by lowering the lift tube assembly with the winch assembly, releasing the ratchet and pawl assemblies and lowering the canopy panel, and raising the filler panel into its storage position. With all panels in their storage positions, the acoustic tower may be easily transported and stored in a nesting fashion with additional acoustic towers.

DESCRIPTION OF THE PREFERRED EMBODIMENTS

I. Structure of Acoustic Tower

Figure 1:
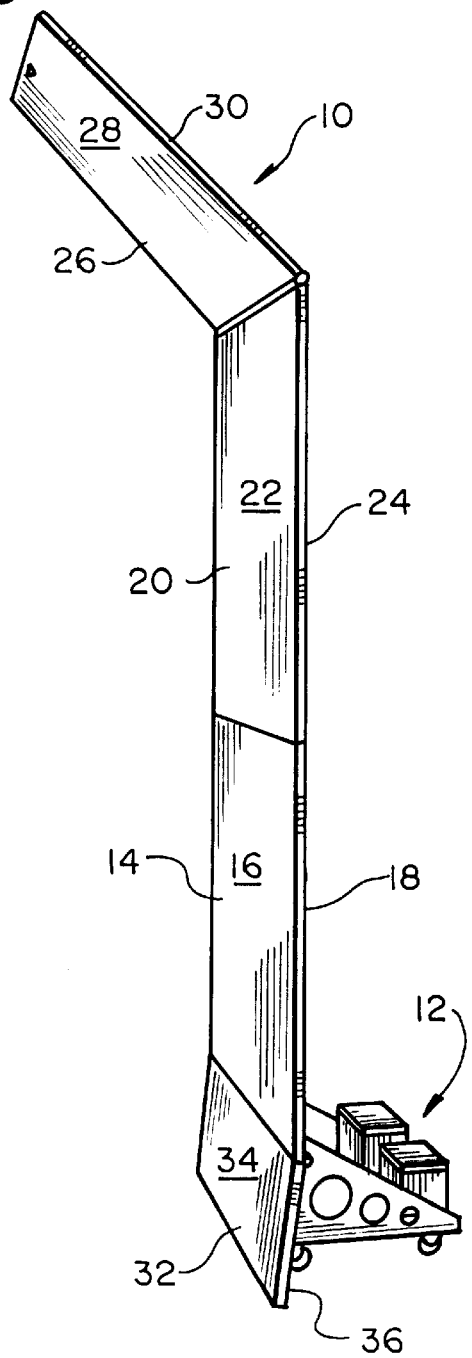
FIG. 1 depicts a side perspective view of an acoustic tower of the present invention in performance position.

An acoustic tower 10 of the present invention is depicted in FIG. 1 in its fully assembled performance position. Acoustic tower 10 generally comprises a base assembly 12 and a plurality of acoustical panels with their accompanying structure. Preferably, acoustic tower 10 includes a lower panel 14 having a front face 16 and rear face 18, an upper panel 20 having a front face 22 and a rear face 24, a canopy panel 26 having a front face 28 and a rear face 30, and a filler panel 32 having a front face 34 and a rear face 36.

Figure 2:
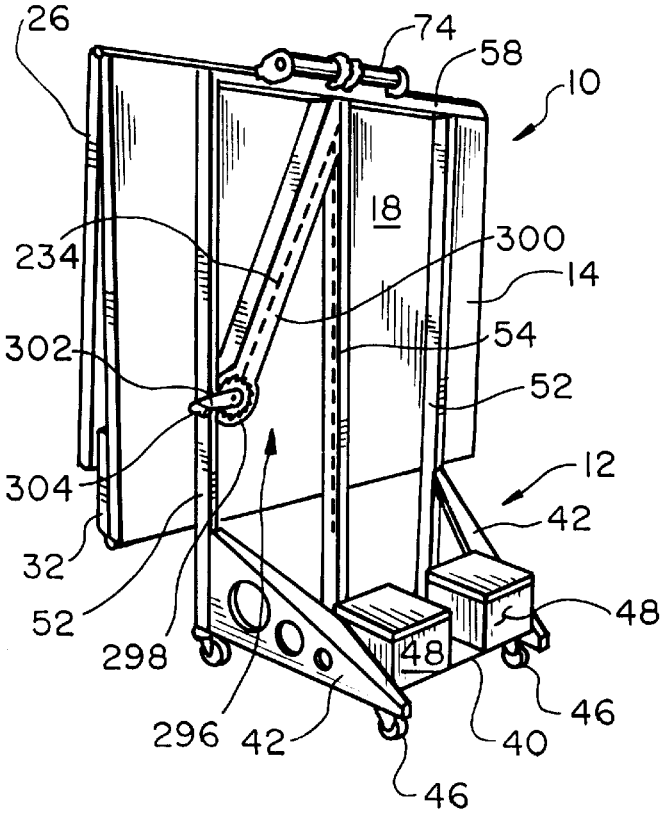
FIG. 2 depicts a rear perspective view of the acoustic tower in a storage position.

FIG. 2 depicts acoustic tower 10 in its storage position and more clearly depicts base assembly 12. As shown, base assembly 12 preferably comprises a base plate 40, a pair of side panels 42 extending upward from base plate 40, a plurality of swiveling casters 46 mounted to the underside of base plate 40 and a pair of concrete counterweights 48 secured atop base plate 40 in protective housings.

Figure 3:
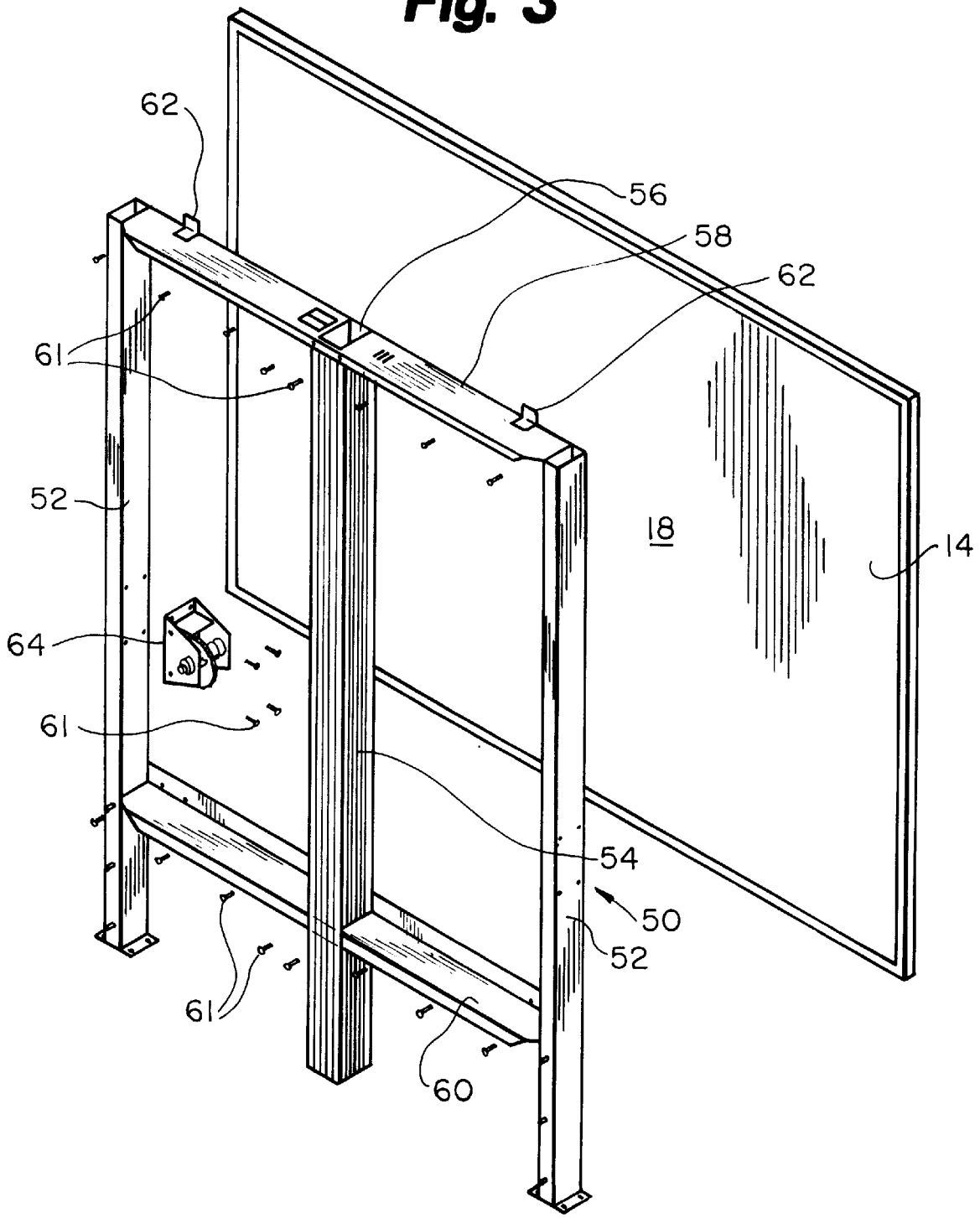
FIG. 3 depicts an assembly view of a lower panel and lower panel assembly of the acoustic tower.

Referring again to FIG. 2 and, as well, to FIG. 3, lower panel assembly 50, the supporting structure of lower panel 14, may be appreciated. Lower panel assembly 50 includes a pair of side supports 52 and a center shaft 54 having side opening 56. An upper cross support 58 and a lower cross support 60 connect side supports 52 and center shaft 54, and are preferably welded to side supports 52. The lower portion of side supports 52 is preferably fastened to base side panels 42 with screws 61 or other appropriate fasteners. Upper cross support 58 is provided with a pair of panel alignment tabs 62. A winch assembly 64 (discussed in detail below) is preferably mounted to the interior of one of side supports 52. Screws 61, or other appropriate fasteners, are used to secure lower panel assembly 50 to lower panel 14.

Referring in general to FIGS. 4-9 lift tube assembly 70 may be appreciated. Upper panel 20 is supported by lift tube assembly 70. Lift tube assembly 70 generally comprises a lift tube 72, which telescopes within center shaft 54, and a cross tube assembly 74 which acts to support canopy panel 26. Lift tube 72 is preferably provided with an upper ramp stop 77 and a lower ramp stop 78 which are secured to lift tube 72 with rivets 79 or other appropriate fasteners. Lift tube 72 is also preferably provided with a roller housing assembly 90. Roller housing assembly includes a roller housing 92 having an upper portion 94, that is inserted within the end of lift tube 72, and a lower portion 95. Lower portion 95 includes an opening 96 for placement of a roller 98 which is held in position with a pin 100. Lower portion 95 further includes pins 102 on either side for placement of ball bearings 104. Cross tube assembly 74 includes a cross tube 106, which is preferably welded to lift tube 72, and a ratchet assembly 108.

Figure 6A:
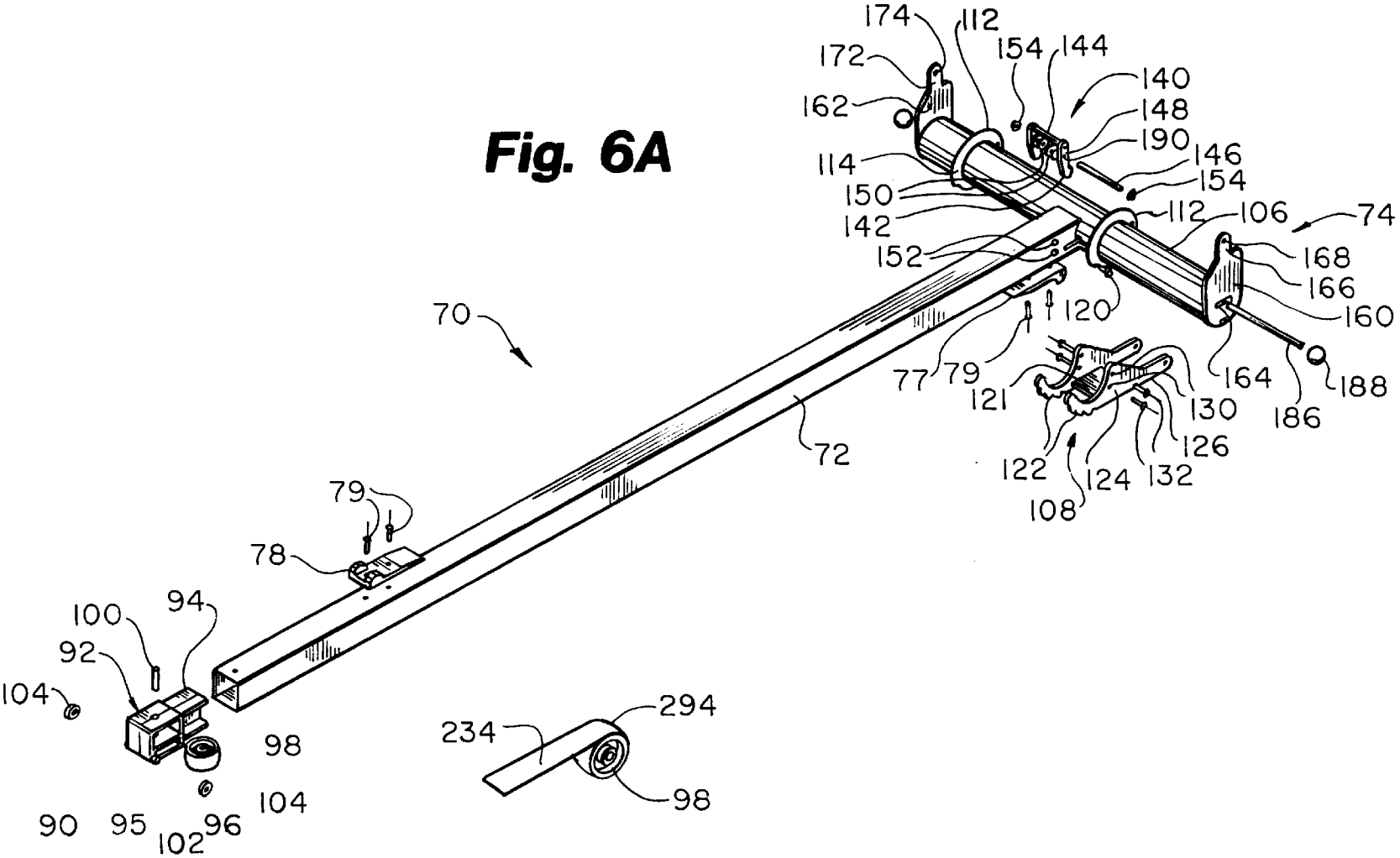
FIG. 6A depicts an assembly view of the lift tube assembly.
Figures 6B, 7, 8:
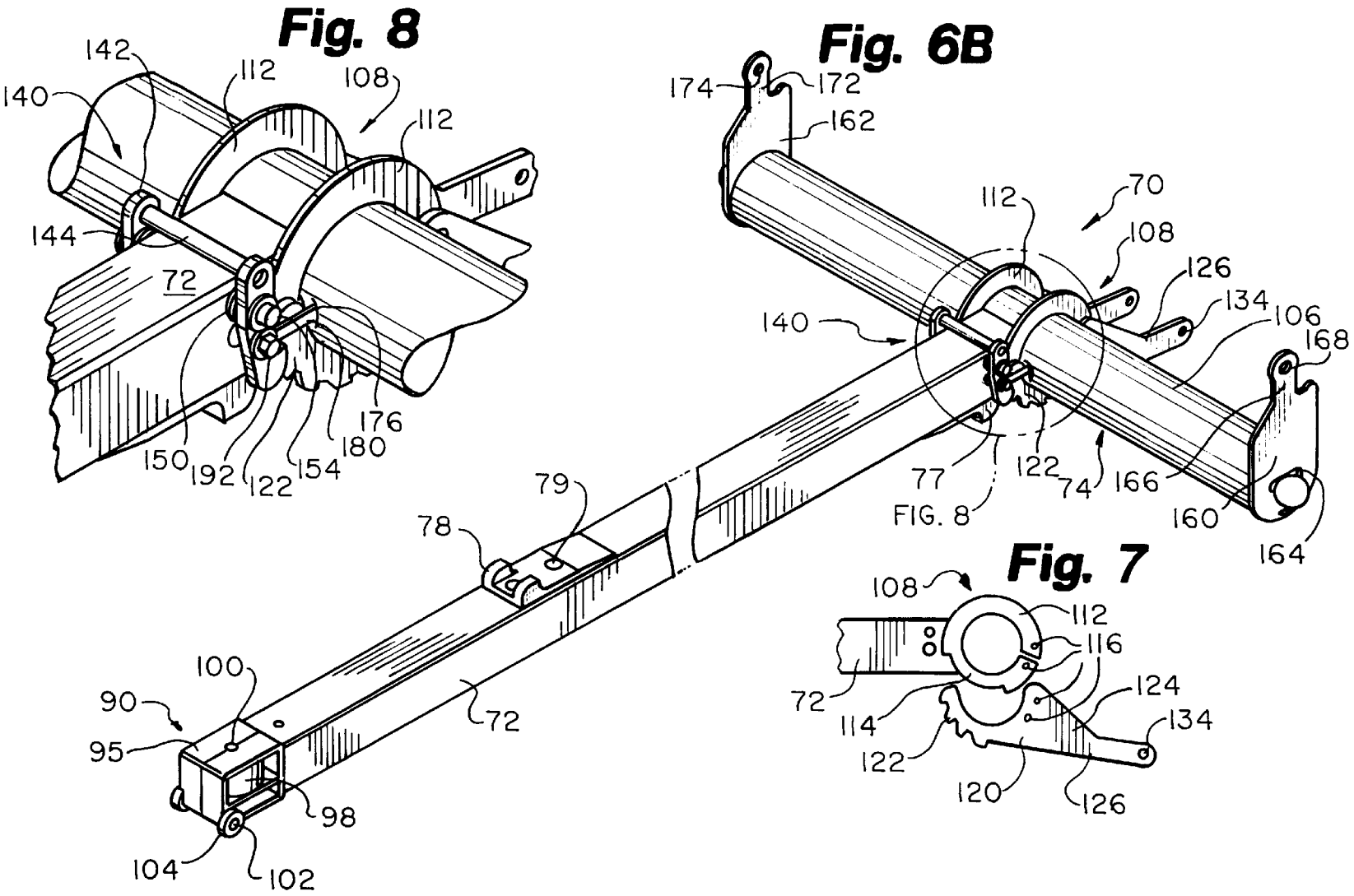
FIG. 6B provides a full perspective view of the lift tube assembly as fully assembled.
FIG. 7 provides a side view of a portion of ratchet assembly of the lift tube assembly.
FIG. 8 depicts detail A of FIG. 6B.

Ratchet assembly 108 comprises a pair of rings 112 which are slid over cross tube 70 to be positioned one on each side of lift tube 72. Each of rings 112 include a notched portion 114 and a plurality of apertures 116. Ratchet assembly 108 further comprises two ratchet plates 120, separated by a spacer plate 121, each having a toothed portion 122, a securement portion 124 and extender arms 126. Toothed portion 122 is preferably aligned with notched portion 114, to the exterior of notched portion 114, while apertures 130 of securement portion 124 are aligned with securement apertures 116, as best seen in FIG. 6B. Blind rivets 132, or other appropriate fasteners, are inserted through apertures 116 and 130 to secure rings 112 and ratchet plates 120; rings 112 and attached ratchet plates 120 should rotate smoothly on cross tube 76, however, some drag is acceptable. Extender arms 126 are each provided with an aperture 134.

Ratchet assembly 108 further comprises pawl assembly 140. Pawl assembly 140 includes a pair of hook arms 142 separated by a spacer shaft 144. Pawl assembly 140 is secured to lift tube 72 by inserting a pin 146 through aperture 148 in each hook arm 142, through washers 150 and through aperture 152 in lift tube 72. Pin 146 is preferably held in position with pushnut 154. Pawl assembly 140 should rotate freely on pin 146.

Cross tube assembly 74 further comprises a first end cap 160 and a second end cap 162. First end cap 160 has an L-shaped slot 164 and an extender arm 166 with aperture 168 therethrough. Second end cap 162 includes an aperture 170 and a corresponding extender arm 172 and aperture 174. A slot opening 176 in cross tube 76 allows a link 180, having a first apertured end 182 and a second apertured end 184, to extend into the interior of cross tube 76. A rod 186 is preferably inserted through L-shaped slot 164, through first apertured end 182 and through aperture 170 where it is held in position with a knob 188 secured at either end. Second apertured end 184 of link 180 is preferably secured to one of hook arms 142 at aperture 190 with a self-tapping screw 192, or other appropriate fastener.

Canopy panel 26 is secured to cross tube assembly 74 in two manners. First, canopy panel 26 is provided with a hinge portion 198 that is designed to mesh with hinge portion 196 of upper panel 20. These hinge portions 196, 198 are placed between extender arms 166 and 172, and are aligned with extender arm apertures 168 and 174; a hinge pin 199, inserted through hinge portions 196, 198 and apertures 168, 174 secures upper panel 20 and canopy panel 26 to lift tube assembly 70. Second, canopy panel 26 is secured to extender arms 126 of ratchet plate 120 through use of a connector rod 200, a first hinge end connector 202, and a second hinge end connector 204. Connector rod 200 is threadably secured on one end to first hinge end connector 202. A pin 206, inserted through apertures 134 in extender arms 126 of ratchet plate 120 and through aperture 210 of first hinge end connector 202, secures connector rod 200 to extender arms 126. Connector rod 200 is threadably secured on its second end to second hinge end connector 204. A hinge bracket 212 is mounted to rear face 30 of canopy panel 26. A pin 214 inserted through aperture 216 of hinge bracket 212 and through aperture 218 of second hinge end connector 204 secures the two together.

Figure 9:
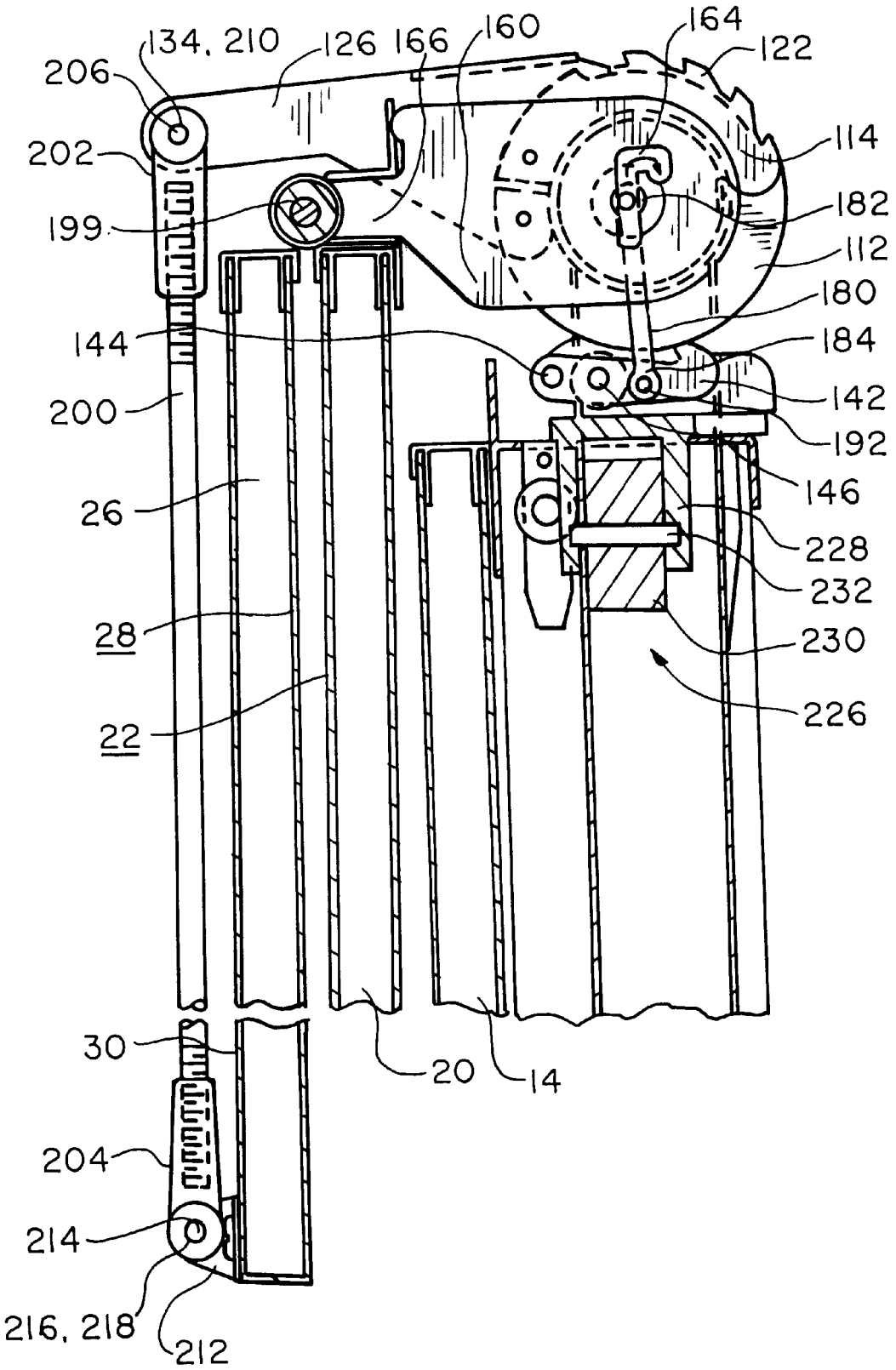
FIG. 9 depicts a fragmentary, side elevational view of the acoustic tower in storage position.

As indicated earlier, acoustic tower 10 of the present invention utilizes a winch assembly 64. Winch assembly 64 works in conjunction with roller housing assembly 90 (shown in FIG. 6B) and with a roller assembly 226 (shown in FIG. 9) to raise and lower lift tube assembly 70. Referring to FIG. 9, roller assembly 226 comprises a bracket 228, secured to upper cross support 58 proximate side opening 56 in center shaft 54, and a roller 230 secured to bracket 228 with a pin 232, see FIG. 5. A length of webbing 234, or other appropriate material, connects winch assembly 64 to roller housing assembly 90 by way of roller assembly 226. The webbing run is indicated by dashed lines in FIG. 2.

Figure 10:
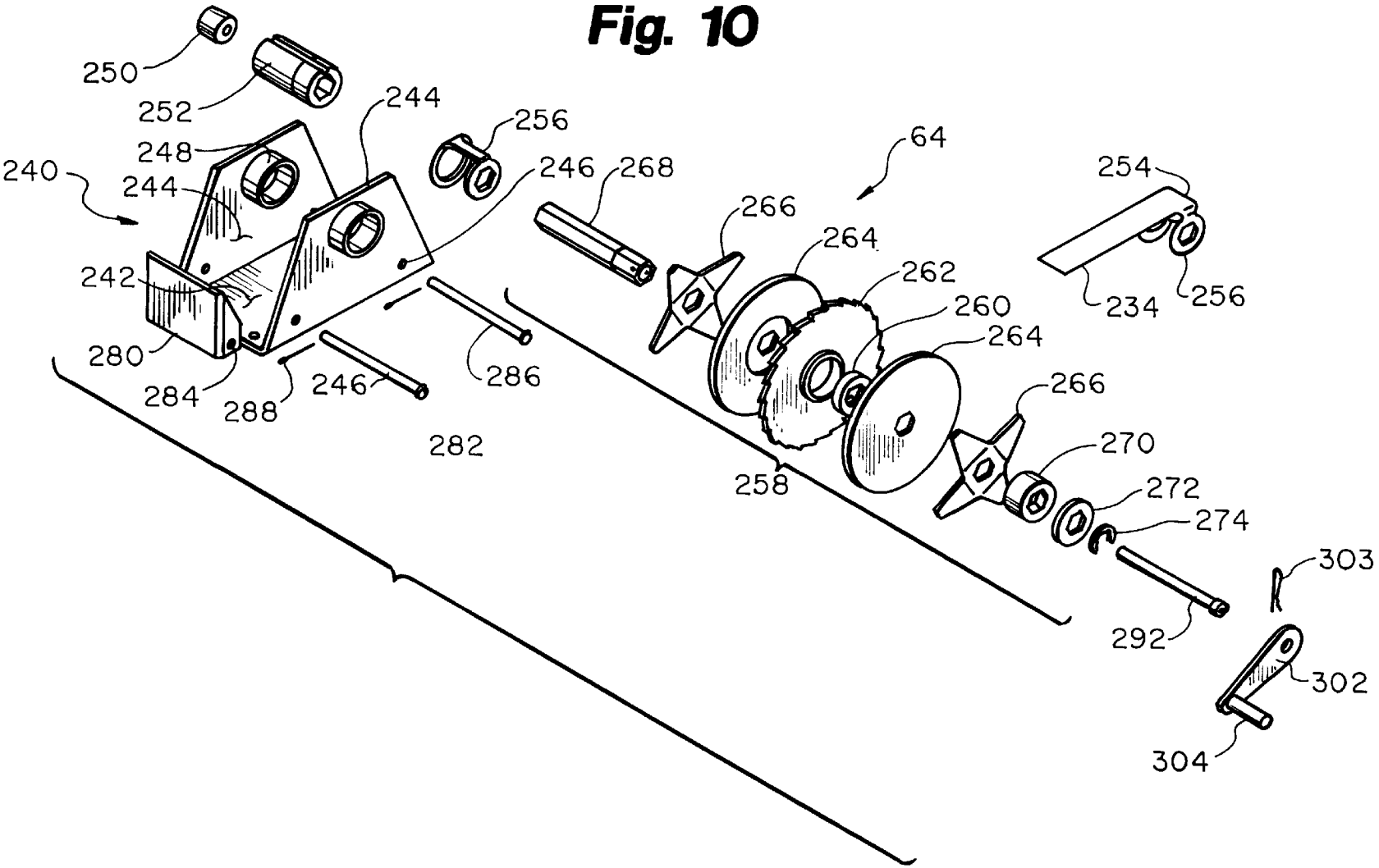
FIG. 10 depicts an assembly view of a winch assembly.
Figure 11:
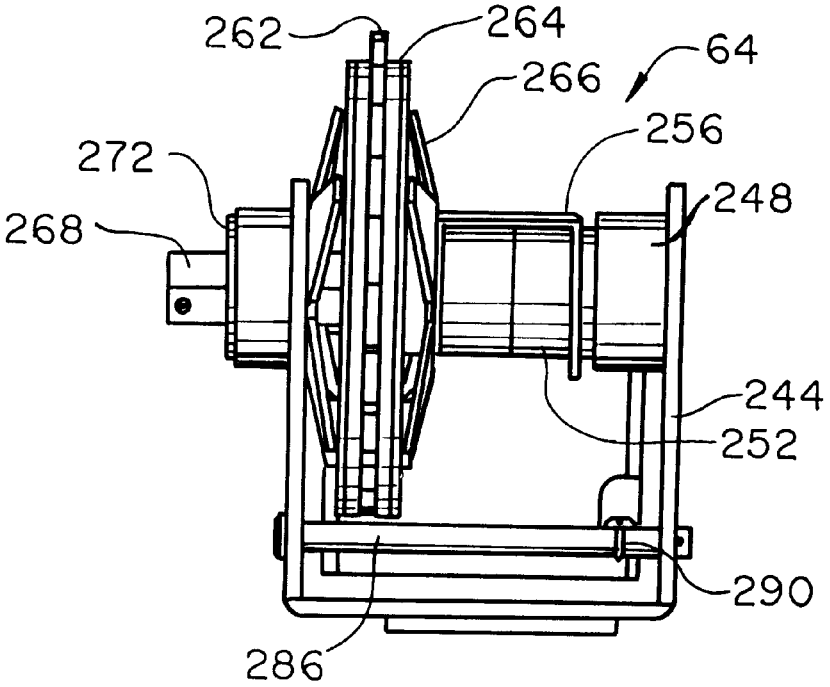
FIG. 11 depicts a front view of the assembled winch assembly of FIG. 10.
Figure 12:
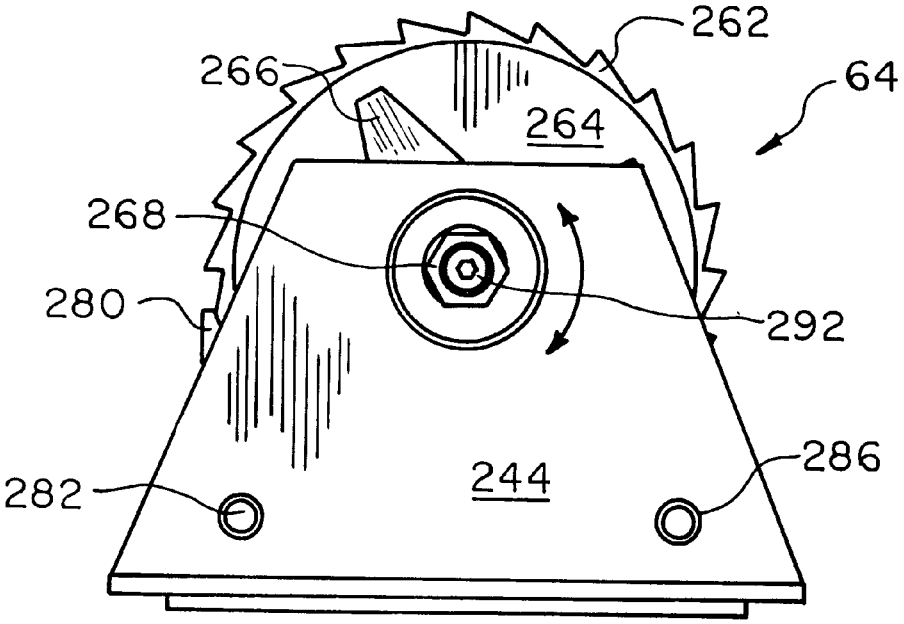
FIG. 12 depicts a side view of the assembled winch assembly of FIG. 10.

Winch assembly 64, as shown in FIGS. 10–12, includes a winch mount 240 comprising a base plate 242 and two side plates 244, each of which include a pair of apertures 246 and a sleeve 248. A nut 250 is inserted within a core 252 which is installed within one of sleeves 248. A first webbing loop 254, located at one end of webbing 234, is slipped over a web clip 256. Web clip 256 is then slid onto core 252. With web clip 256 in place, a clutch stack 258 is formed by stacking a central bearing 260, a ratchet plate 262, a pair of brake discs 264, and a pair of springs 266. Clutch stack 258 is then located within winch mount 240 proximate core 252 and web clip 256. A shaft 268 is then inserted through sleeve 248, through the center of clutch stack 258, operating to align clutch stack 258, through web clip 256 and into core 252. To the exterior of side plate 244, a bearing 270 and a washer 272 are preferably slid onto shaft 268 and secured in place with a c-clip 274 or other appropriate fastener. At this stage in the assembly, clutch stack 258 should turn freely.

A pawl 280 is then preferably mounted to winch mount 240 by inserting a first clevis pin 282 through apertures 246 in side plates 244 and through an aperture 284 in pawl 280. A second clevis pin 286 is inserted through the remaining apertures 246 in side plates 244. Both clevis pins 284, 286 are preferably secured with cotter pins 288 or other appropriate fastener. A spring 290 is secured between pawl 280 and second clevis pin 286. Finally, a screw 292 is installed in shaft 268 and is preferably tightened until it requires 75 LB/IN of torque on shaft 268 (turning counter-clockwise) to over-ride clutch 258. A fixed, or more preferably a removable, handle 302 with foldable crank 304 is provided and is connectable to shaft 268. The removable handle 302 may be secured to shaft 268 with a cotter pin 303 or other appropriate, removable fastener.

Referring back to FIGS. 1, 2 and 3, winch assembly 64 is preferably mounted to the interior of one of side supports 52 with screws 61 or other appropriate fasteners. Webbing 234 is then directed from winch assembly 64 over roller 230 (FIG. 5) through side opening 56, down center shaft 54 and secured with a second webbing loop 294 (not shown) to roller 98 (FIGS. 6A, 6B); the webbing run is indicated by a dashed line in FIG. 2. A web housing assembly 296 includes a winch housing portion 298 for protecting winch assembly 64 and an extender tube portion 300 for protecting the open run of webbing 234.

Figure 13:
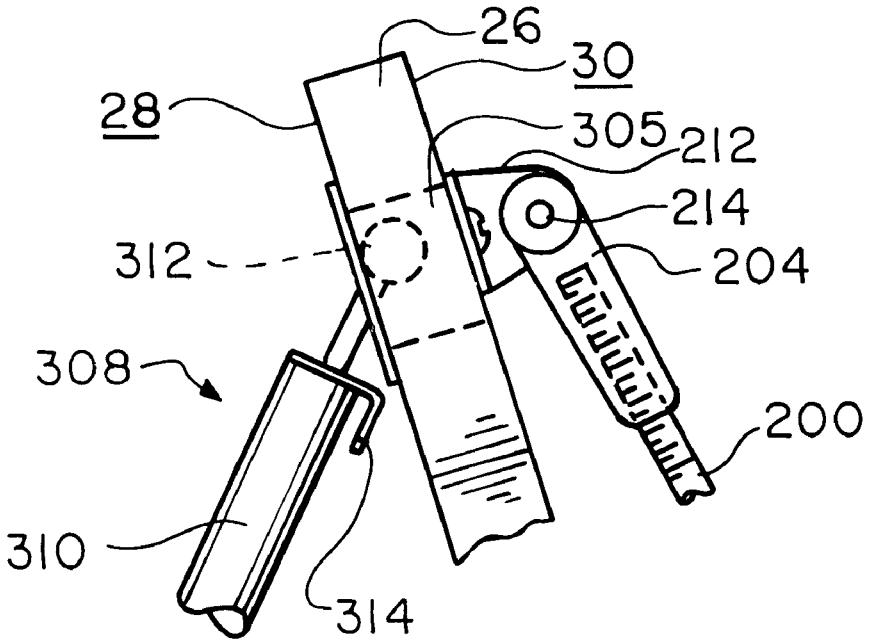
FIG. 13 depicts a fragmentary, side elevational view of a canopy tool within a lift plate of a canopy panel of the acoustic tower.
Figure 14:
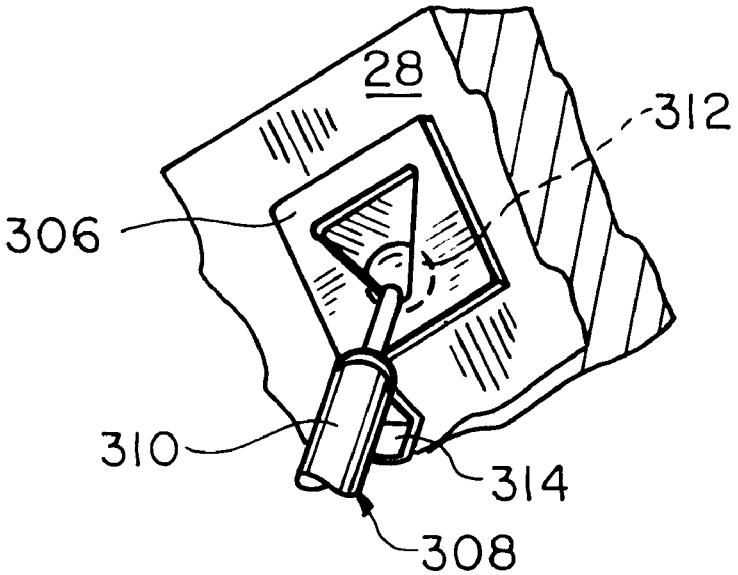
FIG. 14 depicts a fragmentary, front perspective view of the canopy tool within the lift plate of the canopy panel.

Referring to FIGS. 13 and 14, front face 28 of canopy panel 26 is preferably provided with a hook cavity 305 and a triangular lift plate 306, however, other shapes and size of plates may be used without departing from the spirit or scope of the invention. Triangular lift plate 306 is designed to accept a tip of a canopy tool 308. Canopy tool 308 comprises an elongate handle 310 having at one end both a ball tip 312 and a hook tip 314.

Figure 15A:
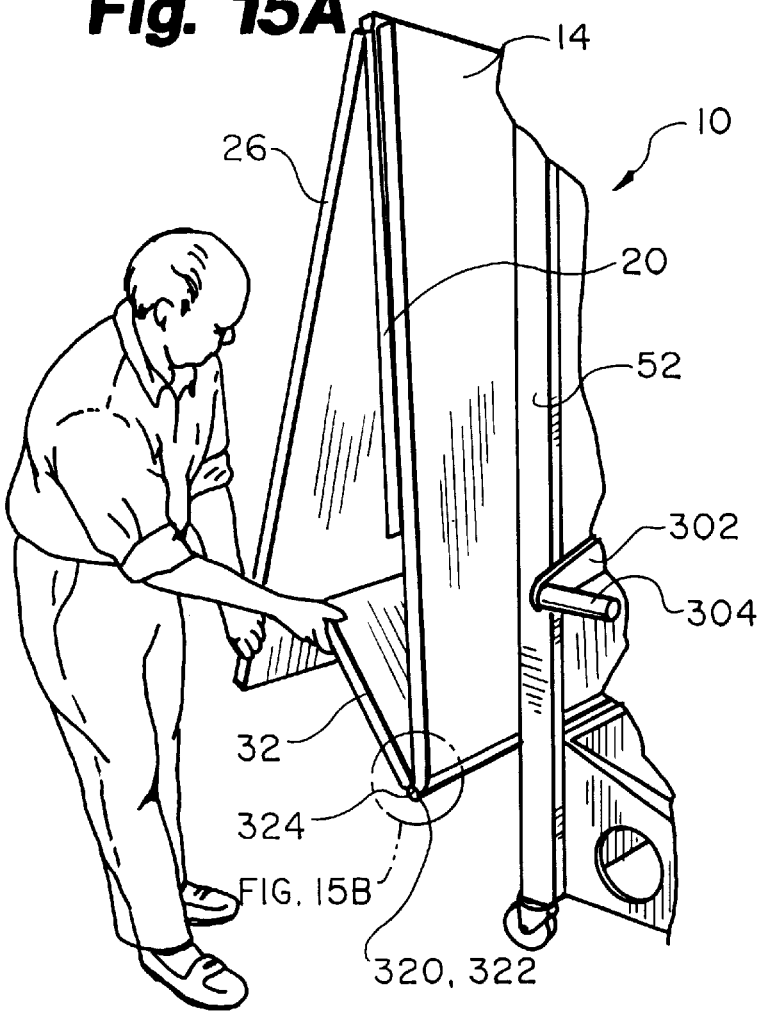
FIG. 15A depicts a fragmentary, perspective view of the acoustic tower and the lowering of a filler panel.
Figure 15B:
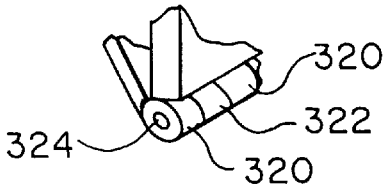
FIG. 15B depicts detail B of FIG. 15A.

Referring to FIGS. 15A and 15B, filler panel 32 is provided with a hinge portion 320 that is designed to mesh with a hinge portion 322 on lower panel 14. Hinge portions 320, 322 are secured with a hinge pin 324 and allow filler panel to rotate between a raised storage position and a lowered performance position.

II. Operation of Acoustic Tower

Acoustic tower 10 is preferably stored in a storage position, as shown in FIG. 2. In the storage position, lift tube assembly 70 is in its lowest position with cross tube assembly 74 lying proximate upper cross support 58. Filler panel 32 is rotated upward and is maintained in its folded position by the weight of canopy panel 26; canopy panel 26 and upper panel 20 hang downward substantially parallel to lower panel 14 as shown in FIG. 9.

Figure 4:
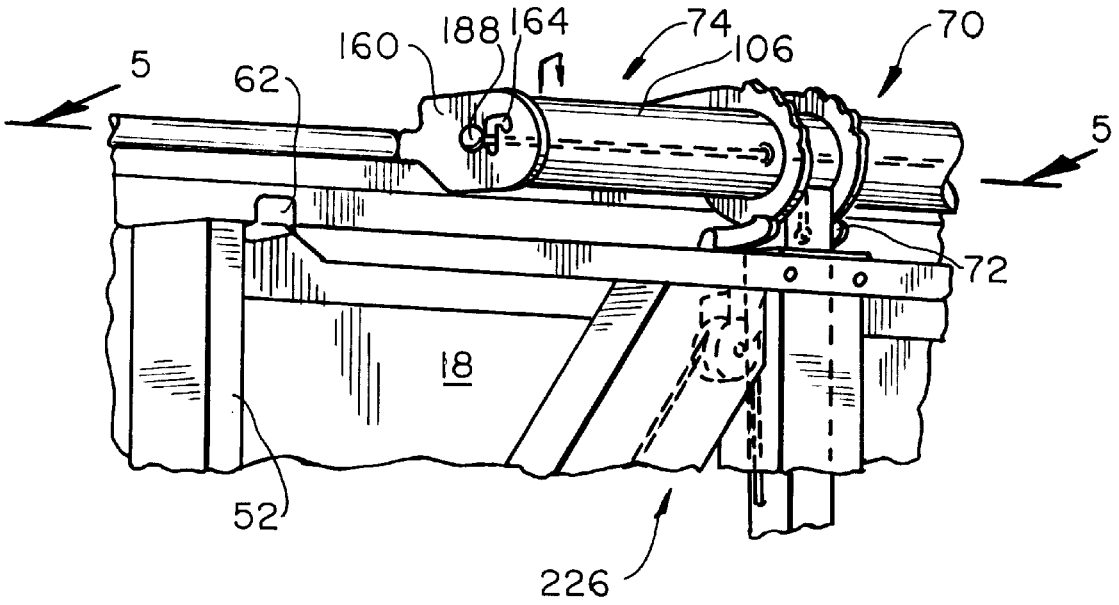
FIG. 4 depicts a fragmentary view of a lift tube assembly relative the lower panel of the acoustic tower.
Figure 5:
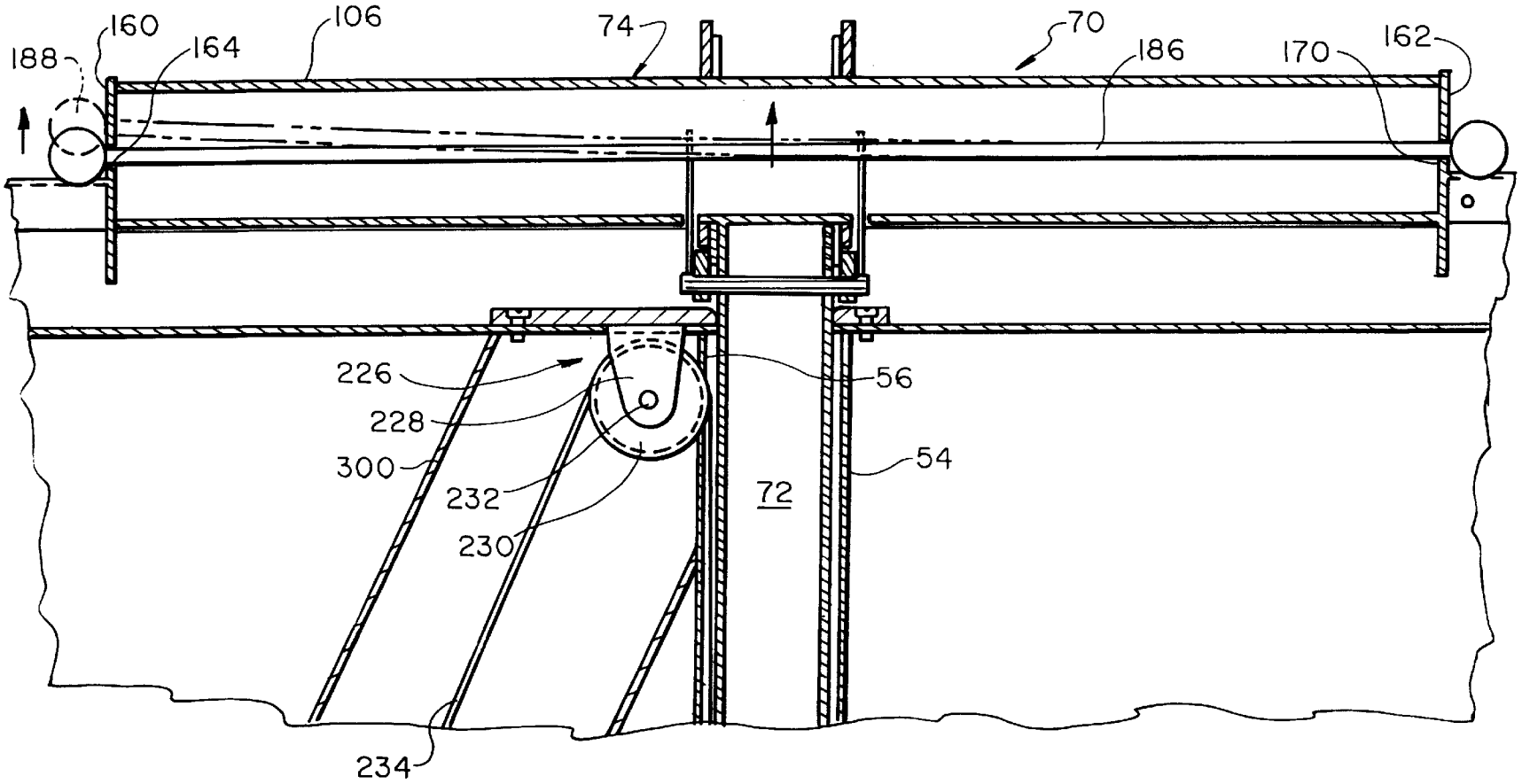
FIG. 5 depicts a cross-sectional view of the lift tube assembly taken along line 5—5 of FIG. 4.

To raise acoustic tower 10 to its performance position, canopy panel 26 is manually, slightly raised to allow for slow manual lowering of filler panel 32, see FIG. 15A. Next, knob 188 is moved within L-shaped slot, which is best seen in FIG. 4, to the short leg of the 'L', or in other words, knob 188 is moved into the "raise" position. This motion lifts rod 186 and correspondingly lifts link 180 and hook arms 142 of pawl assembly 140. Hook arms 142 are now in position to engage toothed portion 122 of ratchet assembly 120 upon the raising of canopy panel 26.

Figure 16:
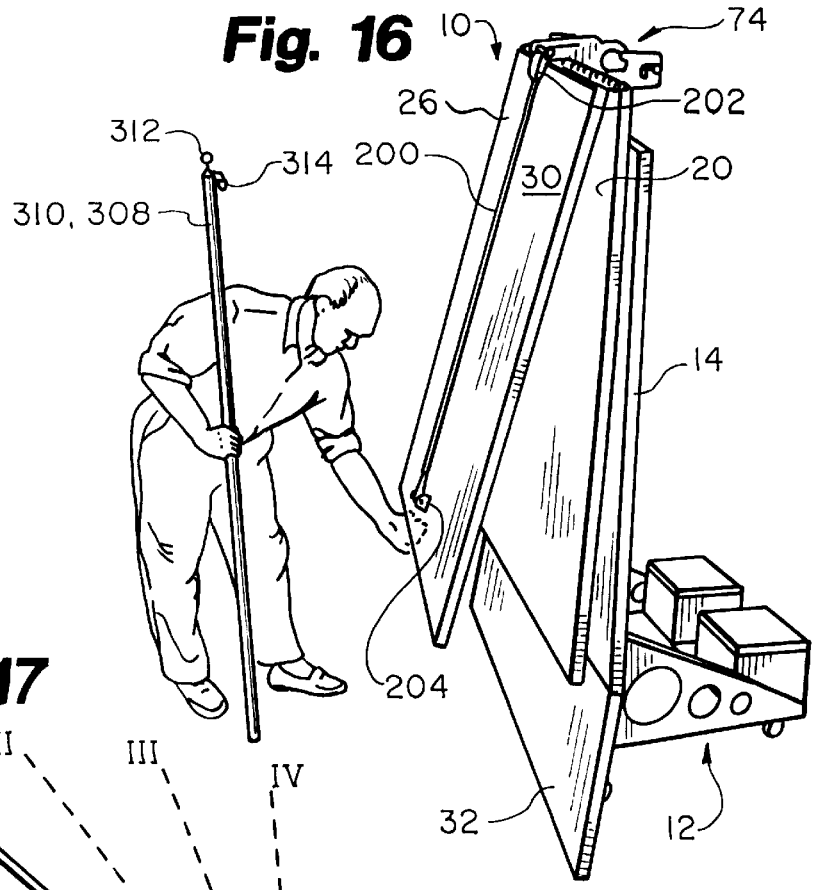
FIG. 16 depicts a perspective of the acoustic tower and the initial lifting of a canopy panel.
Figure 17:
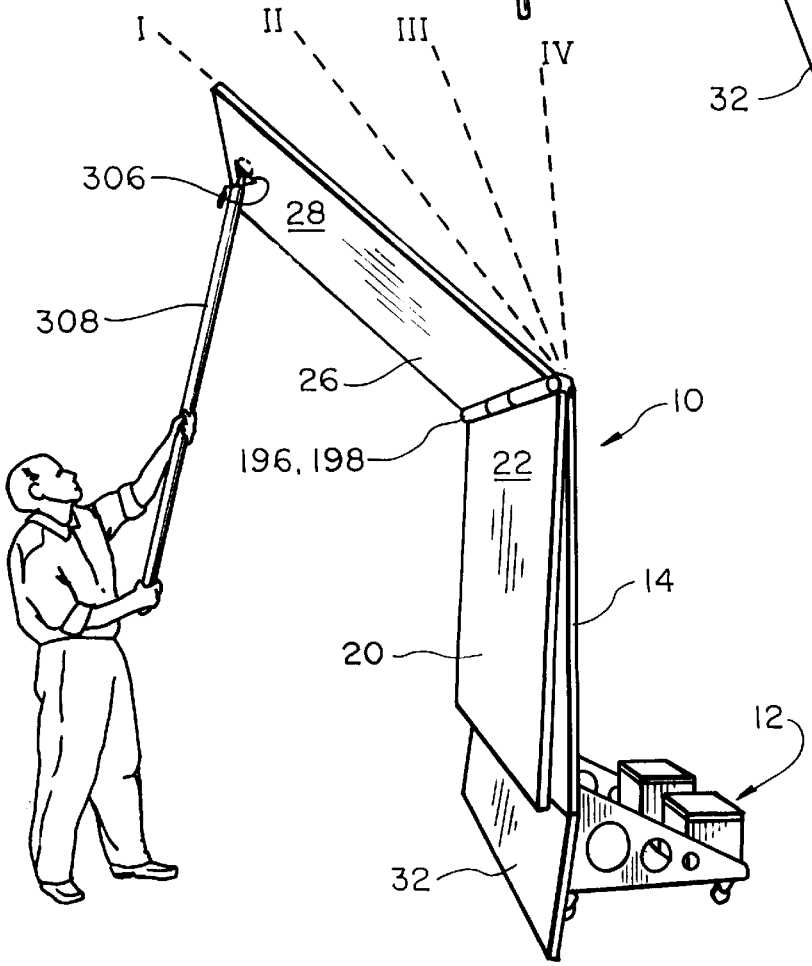
FIG. 17 depicts a perspective of the acoustic tower and the raising of the canopy panel with the canopy tool to one of a plurality of pre-determined angles indicated at points I, II, III and IV.
Figure 18:
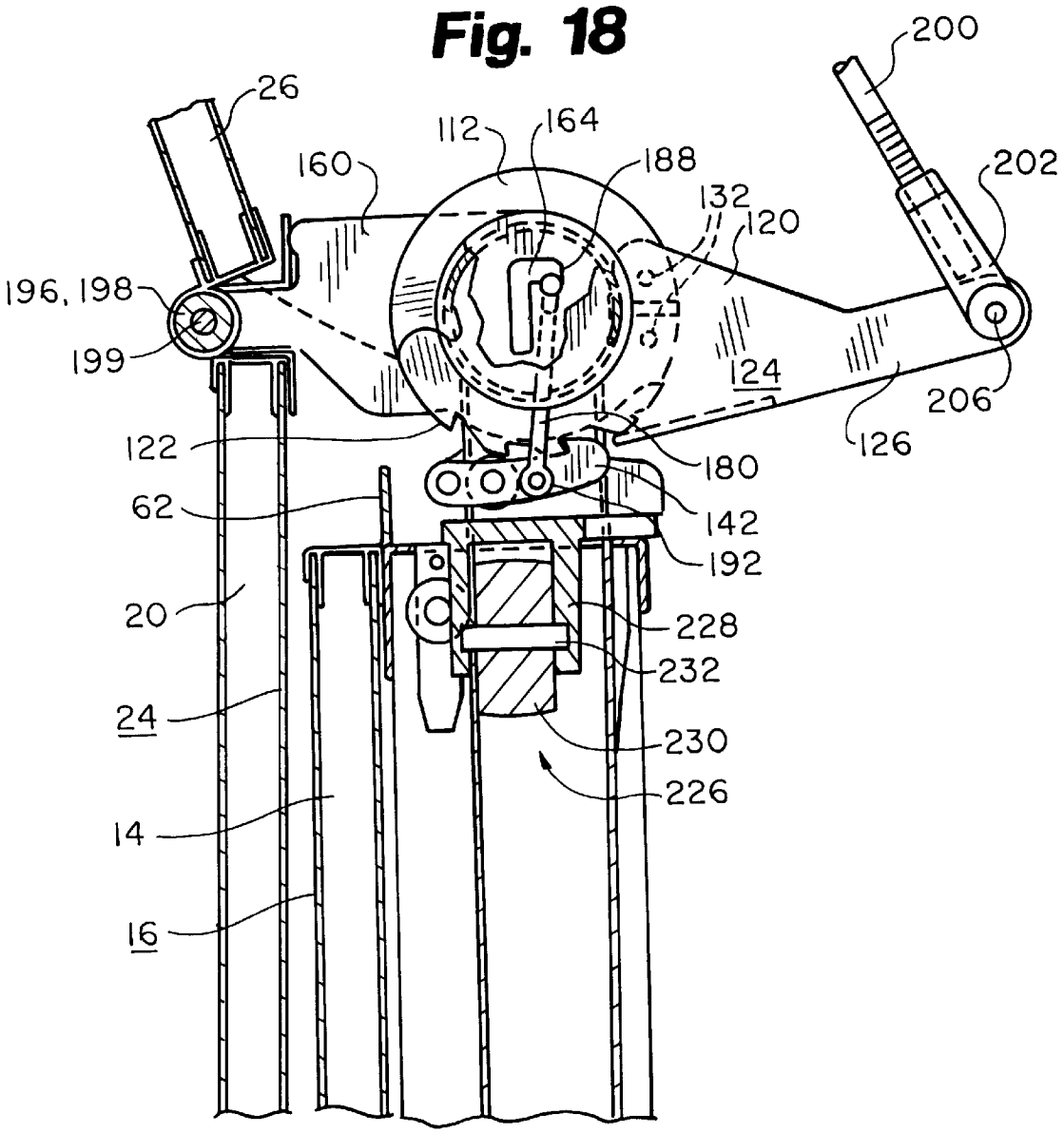
FIG. 18 depicts a fragmentary, side elevational view of the acoustic tower with the canopy panel raised to one of the plurality of pre-determined angles.

To raise canopy panel 26, it is first lifted by hand to a position suitable for insertion of ball tip 312 of canopy tool 308 into triangular lift plate 306, see FIGS. 14, 16. Once in this position, canopy tool 308 is inserted through lift plate 306 and into hook cavity 305. The extended length handle 310 is then used to raise canopy panel 26 to one of a plurality of pre-set angles. Note that while canopy tool 308 is the preferred instrument for raising canopy panel 26, other types of extended length tools may be used without departing from the spirit or scope of the invention. As shown in FIG. 17, canopy panel 26 is preferably raisable to four, predetermined angles, e.g. I–45°, II–60°, III–75° and IV–90°, as measured from the perpendicular to the substantially vertical plane defined by lower panel 14. However, the number and degree of the angles may vary without departing from the spirit or scope of the invention. The angles are generally determined by the location of the teeth on toothed portion 122 of ratchet plate 120. FIG. 18 depicts an example of hook arms 142 engaging the third tooth of toothed portion 122 to present canopy panel at an angle of approximately 75°. Note, that while hook arms 142 are engaged and knob 188 is in the "raise" position, canopy panel 26 cannot be lowered and as such, is substantially tamper proof.

Figure 19:
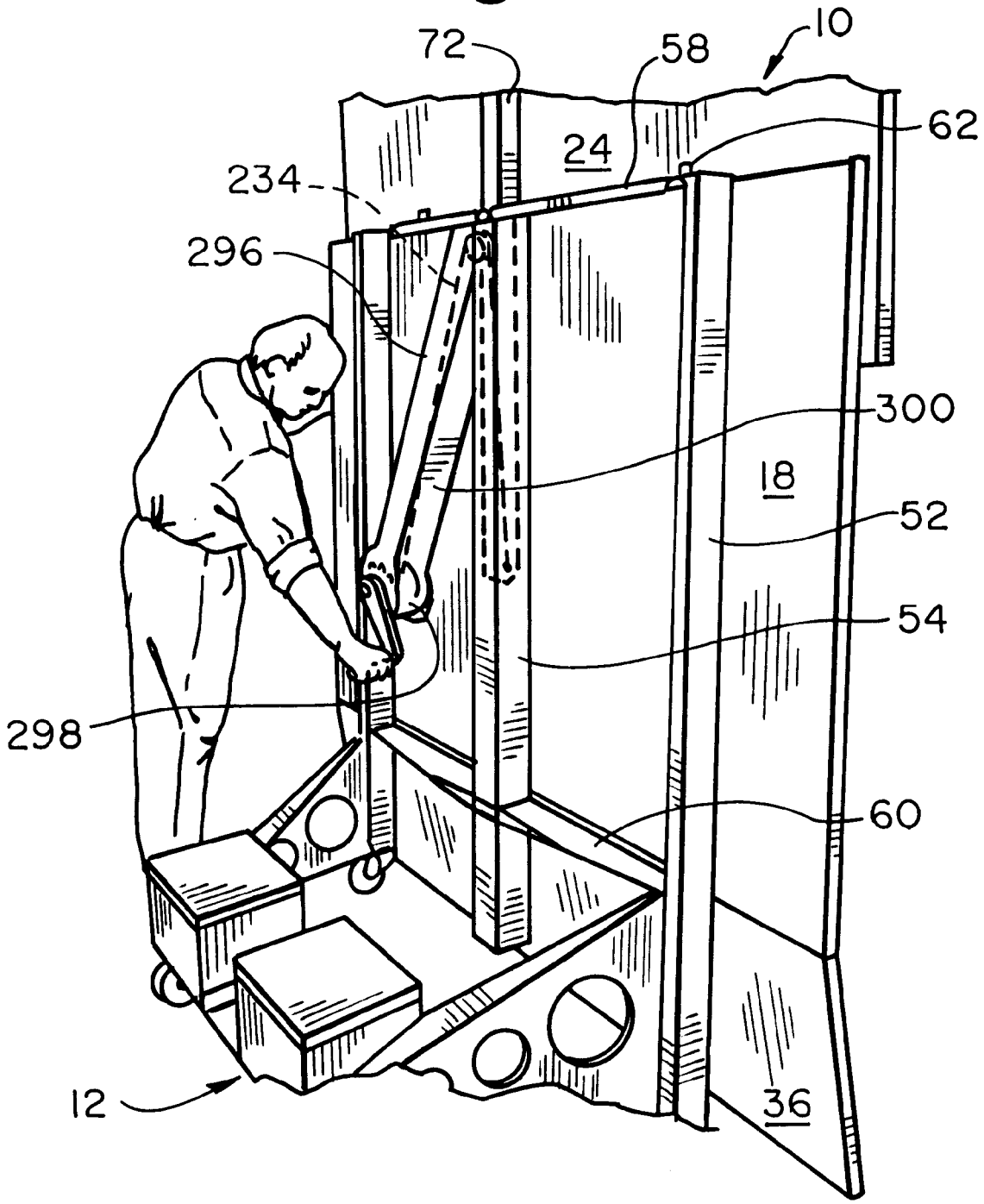
FIG. 19 depicts a fragmentary, perspective view of the acoustic tower and the raising of an upper panel with a winch assembly.
Figure 20:
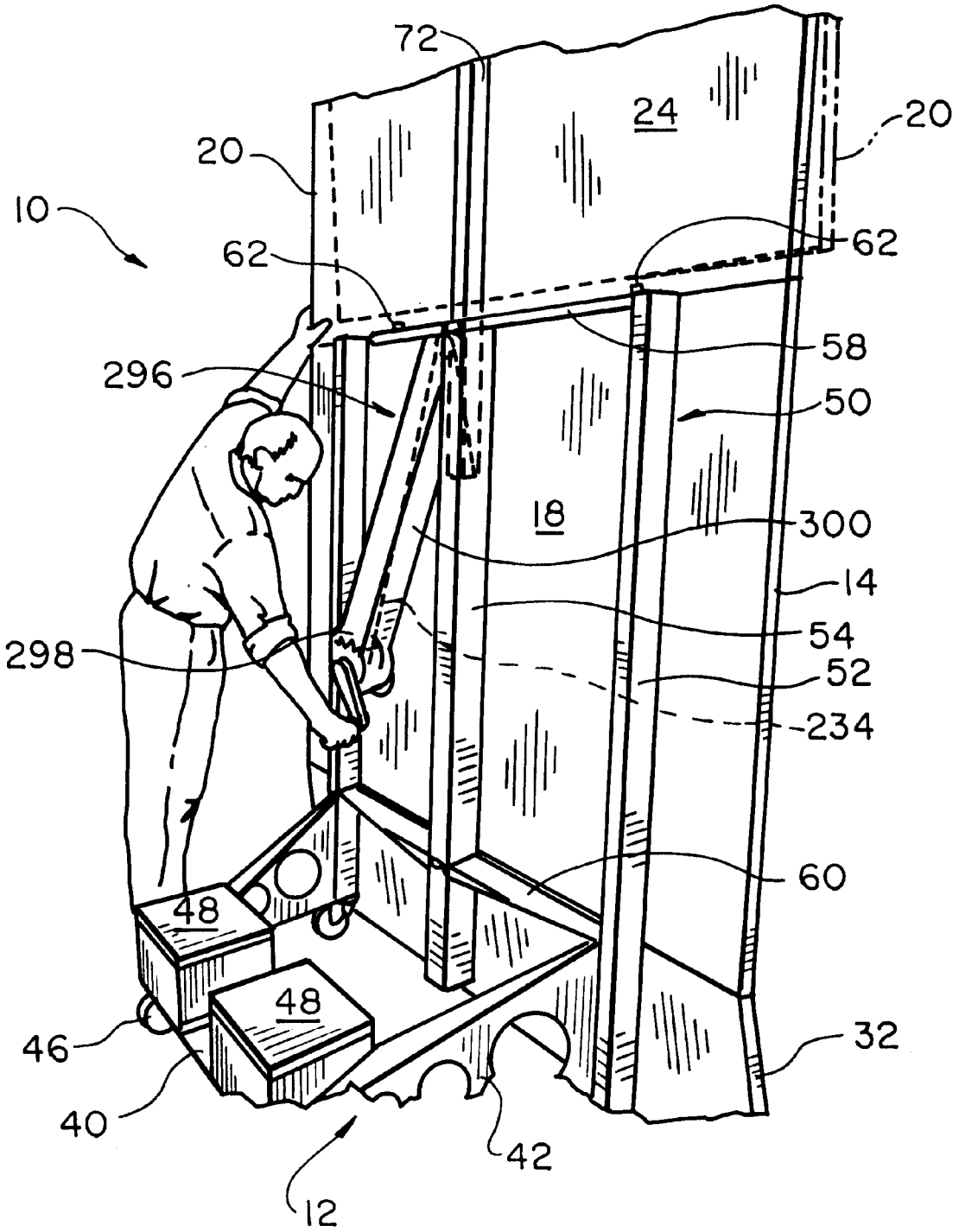
FIG. 20 depicts a fragmentary, perspective view of the acoustic tower with the upper panel in a fully raised position.

Once canopy panel 26 has been raised to the desired angle, upper panel 20 is raised. To raise upper panel 20, crank 304 of handle 302 is extended and handle 302 is preferably turned slowly in a clockwise direction causing winch assembly 64 to draw and wind webbing 234. The drawing and winding of webbing 234 causes lift tube 72 of lift tube assembly 70 to telescopically raise within center shaft 54 of lower panel assembly 50, see FIG. 19. Bearings 104 secured to the exterior of roller housing assembly 90 help to ensure that the traversal of lift tube 72 up center shaft 54 is a smooth one, without binding. Referring to FIG. 20, handle 302 is preferably turned until the bottom edge of upper panel 20 is positioned just slightly above the top edge of lower panel 14, or until lower ramp stop 78 prevents further upward motion of lift tube assembly 70. With upper panel 20 positioned slightly above the top edge of lower panel 14, upper panel 20 is manually pulled backwards against panel alignment tabs 62. While upper panel 20 is held in this position, handle 302 is preferably turned a small distance, e.g. half a turn, in the counterclockwise direction, lowering upper panel 20 to rest atop lower panel 14. Both upper panel 20 and lower panel 14 may be provided with alignment pegs (not shown) that are insertable into apertures within upper panel 20 and lower panel 14 to additionally aid in the alignment positioning of the panels. With acoustic tower 10 now in its performance position, as shown in FIG. 1, handle 302, if removable, may be removed and stored for security purposes. Canopy tool 308 may be stored atop base assembly 12, if desired.

Figure 21:
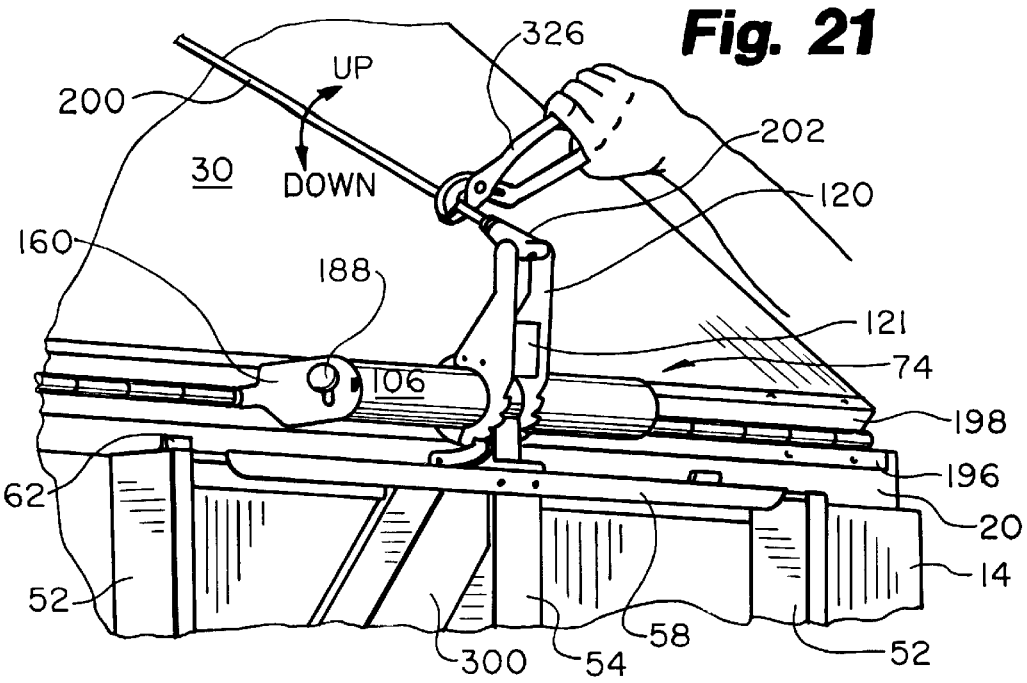
FIG. 21 depicts a fragmentary, perspective view of the acoustic tower and the manual adjustment that may be made to a connector rod.

If using multiple acoustic towers 10 in a staging area to create a shell or enclosure, minor adjustments in the angle of the canopy panels may be needed to create a uniform angle and appearance. To make such an adjustment to canopy panel 26, a pair of pliers 326 is preferably used to turn connector rod 200 within first hinge end connector 202 and second hinge end connector 204, see FIG. 21. The adjustment to connector rod 200 should be made while lift tube assembly 70 is in a lowered position.

To lower acoustic tower 10 from a performance position to a storage position, handle 302 is turned a short distance, e.g. approximately half a turn, clockwise to raise upper panel 20 slightly from its position resting atop lower panel 14. Referring to FIGS. 19 and 20, upper panel 20 is then manually pushed outward to clear lower panel 14. While holding upper panel 20, handle 302 is turned counterclockwise to unwind webbing 234 and cause lift tube 72 of lift tube assembly 70 to telescopically lower within center shaft 54. Again, bearings 104 help to prevent binding of lift tube 72 within center shaft 54 and aid in a smooth lowering transition. Handle 302 is preferably turned until upper ramp stop 77 prevents further downward motion of lift tube assembly 70. Rear face 24 of upper panel 20 is now resting proximate front face 16 of lower panel 14, see FIG. 18.

With upper panel 20 and lift tube assembly 72 completely lowered, canopy panel 26 may be lowered. To ready canopy panel 26 for lowering, knob 188 is moved within L-shaped slot to the long leg of the 'L', or in other words, knob 188 is moved into the "lower" position, best seen in FIG. 4. This motion lowers rod 186 and, correspondingly, lowers link 180 and hook arms 142 of pawl assembly 140. Hook arms 142 are now in position to disengage toothed portion 122 of ratchet assembly 120 upon the lowering of canopy panel 26.

To lower canopy panel 26, canopy tool 308 is inserted within lift plate 306, see FIGS. 13 and 14. Extended length handle 310 is then used to raise canopy panel 26 slightly to disengage hook arms 142 from notched portion 114 of ratchet assembly 108. Canopy panel 26 is then slowly lowered, with canopy tool 308, to a position where front face 28 of canopy panel 26 is proximate front face 22 of upper panel 20, see FIG. 9. Crank 304 of handle 302 is then preferably folded downward to its storage position. Filler panel 32 may now be rotated upward to its storage position between canopy panel 26 and lower panel 14, see FIG. 15A.

Figure 22:
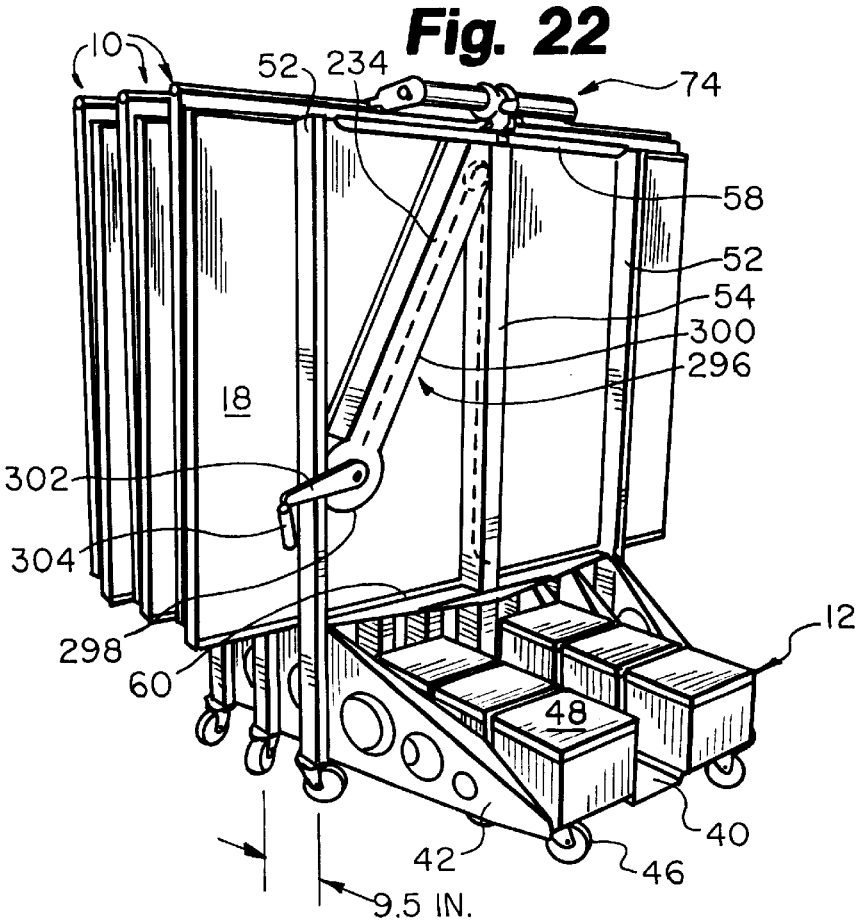
FIG. 22 depicts a perspective view of a plurality of acoustic towers stored in a nesting fashion.

Acoustic tower 10 is now, once again, in its storage position. In this position, a plurality of acoustic towers 10 may be stored together in a nesting fashion as shown in FIG. 22; base assembly 12 of one acoustic tower 10 nested within the base assembly 12 of a second acoustic tower 10 (nesting requires only an additional 9½ inches of depth if the preferred acoustic tower 10 dimensions described below are used). Acoustic tower 10 preferably has storage dimensions of 72 inches in width, 78½ inches in height and 34¼ in depth, however, other dimensions may be used without departing from the spirit or scope of the invention. The preferred dimensions enable acoustic tower 10 in its storage position to pass through a 35 inch by 79 inch opening (a typical 36 inch door) when rolled sideways on swivel casters 46.

Acoustic panels 14, 20, 26 and 32 are preferably of a standard hardboard material having a smooth, painted side and a textured opposite side. The structure of acoustic tower 10 is preferably fabricated from steel. Note that acoustic tower 10 and its component parts may be fabricated from numerous other materials without departing from the spirit or scope of the invention.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

I claim:

1. A system for adjusting the angular position of a panel of an acoustic tower, wherein said acoustic tower comprises at least a first panel and a second panel, wherein said second panel has a first end, is substantially vertical and defines a substantially vertical plane and wherein said first panel is rotatable about said first end of said second panel, said system comprising:

an assembly for raising said first panel to a performance position at one of a plurality of pre-set angles, wherein each of said plurality of pre-set angles comprises an angle greater than the perpendicular to said substantially vertical plane; and a cross tube assembly having a ratchet assembly for releasably maintaining the raised first panel at the pre-set angle.

2. The system of claim 1, wherein said raising assembly is for releasing said first panel from its pre-set angle maintained by said cross tube assembly and said ratchet assembly and for lowering said first panel to an angle less than the perpendicular to said plane.

3. The system of claim 2, wherein said raising assembly is for lowering said first panel to a storage position substantially parallel to said second panel.

4. The system of claim 1, wherein said plurality of pre-set angles are in the range of 45 degrees to 90 degrees as measured from the perpendicular to said substantially vertical plane.

5. The system of claim 1, wherein said raising assembly comprises an elongate handle.

6. The system of claim 1, wherein said cross tube assembly and said ratchet assembly is adjustable between a raised position, to allow for raising of said first panel to said performance position, and a lowered position, to allow for lowering of said first panel to a storage position.

7. The system of claim 1, wherein said cross tube assembly and said ratchet assembly further includes an adjustment rod.

8. The system of claim 7, wherein said adjustment rod may be adjusted to modify the pre-set angle.

9. A system for raising a panel of an acoustic tower, wherein said acoustic tower comprises at least a first panel and a second panel, and wherein said second panel is movable between a storage position and a performance position relative said first panel, said system comprising:

a first support structure secured to said first pane, wherein said first support structure has a longitudinal opening therethrough;

a second support structure secured to said second panel, said second support structure positioned relative said first support structure so as to be slidable within said longitudinal opening of said first support structure; and an assembly comprising a line and a line winder, wherein said line winder is located proximate said first support structure, and wherein said line is secured to said line winder and to said second support structure, and wherein the winding of said line by said line winder slides said second support structure within said longitudinal opening and lifts said second panel from said storage position to said performance position.

10. The system of claim 9, wherein said second support structure includes a stop to prevent the lifting of said second panel beyond said performance position.

11. The system of claim 9, wherein said assembly further comprises a handle removably secured to said line winder.

12. The system of claim 9, wherein said second support structure includes bearings to enhance the sliding of said second support structure within said longitudinal opening.

13. The system of claim 9, wherein said line and said line winder are substantially enclosed in a housing.

14. The system of claim 9, wherein said assembly is mounted to said first support structure.

15. The system of claim 9, wherein said second panel is positioned substantially parallel to said first panel in said storage position.

16. The system of claim 9, wherein said second panel is in substantial vertical alignment with said first panel in said performance position.

17. The system of claim 9, wherein said line winder includes a device to inhibit unwinding of said line when said second panel is in said performance position.

18. An acoustic tower adjustable between a storage position and a performance position, said acoustic tower comprising:

a first acoustic panel including a cavity for insertion of a lifting tool;

a second acoustic panel having a first end and a second end, wherein said first acoustic panel is rotatable about said first end and wherein said first acoustic panel is rotatably raisable to said performance position at one of a plurality of preset angles; and a third acoustic panel having a first end and a second end, wherein said second acoustic panel is slidably secured to said third acoustic panel, and wherein said second acoustic panel is slidable between said storage position, proximate and substantially parallel said third acoustic panel, and said performance position, above said third acoustic panel wherein said second end of said second acoustic panel and said first end of said third acoustic panel are in substantial vertical alignment.

19. The acoustic tower of claim 18, wherein said second acoustic panel defines a substantially vertical plane and wherein each of said plurality of pre-set angles comprise an angle greater than the perpendicular to said substantially vertical plane.

20. The acoustic tower of claim 19, wherein said plurality of pre-set angles are in the range of 45 to 90 degrees.

21. The acoustic tower of claim 18, further comprising a mechanical assisting means operably coupled to said first acoustic panel for releasably maintaining the raised first acoustic panel at said one of a plurality of pre-set angles.

22. The acoustic tower of claim 18, wherein said third acoustic panel is supported by a first support structure having a longitudinal opening therethrough and wherein said second acoustic panel is supported by a second support structure positioned relative said first support structure so as to be slidable within said longitudinal opening.

23. The acoustic tower of claim 22, further comprising a mechanical assisting means operably coupled to said first acoustic panel for releasably maintaining the raised first acoustic panel at said one of a plurality of pre-set angles and wherein said mechanical assisting means is mounted atop said second support structure.

24. The acoustic tower of claim 22, further comprising an assembly, said assembly comprising a line and a line winder, wherein said line winder is located proximate said first support structure, and wherein said line is secured to said line winder and to said second support structure, and wherein the winding of said line by said line winder slides said second support structure within said longitudinal opening and lifts said second panel from said storage position to said performance position.

25. The acoustic tower of claim 24, wherein said assembly further comprises a handle removably secured to said line winder.

26. The acoustic tower of claim 18, further comprising a fourth acoustic panel, wherein said fourth acoustic panel is rotatable about the second end of said third acoustic panel.

27. The acoustic tower of claim 26, wherein said fourth acoustic panel is in substantial vertical alignment with said third acoustic panel in said performance position.

28. The acoustic tower of claim 18, wherein said first acoustic panel is substantially parallel to said second acoustic panel in said storage position.

29. A method of assembling an acoustic tower to a performance position, said acoustic tower having a first acoustic panel having a first panel cavity, a second acoustic panel defining a substantially vertical plane and having a first end and a second end, said first acoustic panel rotatable about said first end, and a third acoustic panel having a first end and a second end, said second acoustic panel slidably secured to said third acoustic panel, the method comprising the steps of:

rotatably lifting said first acoustic panel from a storage position to said performance position at one of a plurality of pre-set angles relative said substantially vertical plane by inserting a lifting tool in the first panel cavity;

maintaining said raised first acoustic panel at said one of said plurality of pre-set angles; and slidably lifting said second acoustic panel from a storage position to a performance position wherein said second acoustic panel is in substantial vertical alignment with said third acoustic panel.

30. The method of claim 29, wherein said storage position of said first acoustic panel is proximate and substantially parallel to said second acoustic panel.

31. The method of claim 29, wherein said storage position of said second acoustic panel is proximate and substantially parallel to said third acoustic panel.

32. The method of claim 29, wherein said acoustic tower further comprises a fourth panel rotatable about said second end of said third acoustic panel and wherein said method further comprises the step of rotatably lowering said fourth acoustic panel from a storage position to a performance position in substantial vertical alignment with said third acoustic panel.

33. The method of claim 32, wherein said storage position of said fourth acoustic panel is proximate and substantially parallel to said third acoustic panel.

34. The method of claim 29, wherein each of said plurality of pre-set angles comprise an angle greater than the perpendicular to said substantially vertical plane.

35. The method of claim 34, wherein said plurality of pre-set angles are in the range of 45 to 90 degrees.

36. The method of claim 29, wherein said acoustic tower further comprises an assembly having a line and a line winder, and wherein said line winder is located proximate said third acoustic panel, and wherein said line is connected between said line winder and said second acoustic panel, and wherein the step of slidably lifting comprises winding said line about said line winder, said second acoustic panel being lifted by said winding line.

37. The method of claim 29, wherein the step of maintaining said firsed first acoustic panel is performed by a cross-tube assembly, including a ratchet assembly, secured to said first acoustic panel.

38. The method of claim 29, further comprising the step of lowering said second acoustic panel to enable said second end of said second acoustic panel to rest atop said first end of said third acoustic panel.

* * * * *

UNITED STATES PATENT AND TRADEMARK OFFICE

CERTIFICATE OF CORRECTION

PATENT NO. : 6,085,861
DATED : July 11, 2000
INVENTOR(S) : Jines

It is certified that error appears in the above-identified patent and that said Letters Patent is hereby corrected as shown below:

Column 2,
Line 4, delete “phsically” and insert -- physically --.
Line 5, after “to” delete “a”.
Line 7, delete “hysically” and insert -- physically --.
Line 8, after “structure to the” insert -- right side of the acoustic shell and insert a locking pin in the frame structure to the --.
Line 14, delete “turnbuckly” and insert -- turnbuckle --.

Column 5,
Line 31, delete “70” and insert -- 106 --.

Column 10,
Line 13, delete “pane,” and insert -- panel, --.

Column 12,
Line 43, delete “firsed” and insert -- raised --.

Signed and Sealed this

Twenty-third Day of December, 2003

JAMES E. ROGAN
*Director of the United States Patent and Trademark Office*